US006631763B1

(12) United States Patent
Self et al.

(10) Patent No.: US 6,631,763 B1
(45) Date of Patent: Oct. 14, 2003

(54) METHOD AND SYSTEM FOR TESTING A BOREHOLE BY THE USE OF A MOVABLE PLUG

(75) Inventors: John Self, Stavanger (NO); Rolf Dirdal, Sola (NO)

(73) Assignee: Den Norske Stats Oljeselskap A.S., Stavanger (NO)

( * ) Notice: Subject to any disclaimer, the term of this patent is extended or adjusted under 35 U.S.C. 154(b) by 0 days.

(21) Appl. No.: 09/937,795

(22) PCT Filed: Mar. 29, 2000

(86) PCT No.: PCT/NO00/00110

§ 371 (c)(1),
(2), (4) Date: Feb. 5, 2002

(87) PCT Pub. No.: WO00/58604

PCT Pub. Date: Oct. 5, 2000

(30) Foreign Application Priority Data

Mar. 30, 1999 (NO) ..... 19991577

(51) Int. Cl.[7] ..... E21B 47/00

(52) U.S. Cl. ..... 166/252.1; 166/353; 166/386; 166/387; 166/116; 166/141

(58) Field of Search ..... 166/250.01, 252.1, 166/250.04, 250.08, 298, 353, 386, 387, 101, 115, 116, 141, 142, 156

(56) References Cited

U.S. PATENT DOCUMENTS 4,413,370 A 11/1983 Payne et al.
4,498,932 A 2/1985 Kruka
4,766,955 A 8/1988 Petermann
5,295,279 A 3/1994 Cooper
5,797,993 A 8/1998 Woehleke
6,390,200 B1 * 5/2002 Allamon et al.
6,467,546 B2 * 10/2002 Allamon et al.

FOREIGN PATENT DOCUMENTS

EP 0 092 975 A1 11/1983
EP 0 903 464 A3 3/1999
EP 0 903 464 A2 3/1999

* cited by examiner

*Primary Examiner*—Roger Schoeppel
(74) *Attorney, Agent, or Firm*—Scully, Scott, Murphy & Presser

(57) ABSTRACT

A method and a system for testing a borehole in an underground formation by the use of so-called closed chamber testing. When carrying out the method, a test or production pipe (5) is carried down the borehole, where the test pipe can be closed at its upper end and at its lower end is provided with a downhole assembly (6) comprising equipment for testing of fluid flow from the formation (3), the annulus (23) between the test pipe (5) and a casing (20) in the borehole being shut off during the test by a gasket (22) at a desired depth, and fluid from the formation being allowed to flow through the test pipe (5) to a collecting tank (9) coupled to the test pipe via a flow head (4) at the upper end of the test pipe (5). In the downhole assembly (6) at the lower end of the test pipe (5) there is releasably retained a pig (30) forming a barrier between formation fluid and a lightweight damping fluid (7) filling the test pipe above the pig, the pig (30) being released at the start of the test and being moved in a controlled manner upwards in the pipe (5) as a result of a positive pressure difference between the fluids below and above the pig.

13 Claims, 10 Drawing Sheets

METHOD AND SYSTEM FOR TESTING A BOREHOLE BY THE USE OF A MOVABLE PLUG

The invention relates to a method of testing a borehole in an underground formation by the use of so-called closed chamber testing, wherein a test pipe is lowered into the borehole, which pipe is closable at its upper end and at its lower end is provided with a downhole assembly comprising equipment for testing of fluid flow from the formation, the annulus between the test pipe and a casing in the borehole being shut off during the test by a gasket at a desired depth, and fluid from the formation being allowed to flow through the test pipe to a collecting tank coupled to the test pipe at the upper end thereof.

Further, the invention relates to a system for such testing, comprising a test pipe which is adapted to be lowered into the borehole and at its lower end is provided with a downhole assembly comprising equipment for testing of fluid flow from the formation, a gasket for shutting off the annulus between the test pipe and a casing in the borehole, and a collecting tank coupled to the test pipe via a flow head at the upper end of the test pipe.

As will be known to a person skilled in the art, testing of petroleum wells are carried out to find out the petroleum production potential of the well and to measure the properties, characteristic and spreading of the reservoir and the reservoir fluid. In such testing, different testing methods are used, including so-called closed chamber testing. The existing methods of this type typically utilize an empty chamber (filled with air or nitrogen), which produces a high differential pressure over the reservoir surface. This results in a shock wave with high velocity, which is intended to remove possible debris or possible blockings from the perforation tunnels, but may also result in formation brake-down. The inflow velocity at the beginning will be high, but will decrease as the chamber is filled with a heavier fluid.

The known systems have a number of weaknesses which can be summarized as follows:

- mixing of borehole and reservoir-fluids,
- lack of accurate flow velocity measurements and volume control,
- lacking ability of achieving representatives specimens of borehole fluids because of contamination,
- constantly varying flow velocities, the chamber typically running "empty", so that an initial shock wave will arise, followed by gradually lower velocities as the chamber is filled,
- high probability of slug flow (irregular two-phase flow) from zones having a low productivity because of gas breakouts,
- no real time downhole data
- interpretation of transient data because of varying flow velocity and storage effects,
- not suitable for testing of wells having a high flow potensial.

On this background it is a general object of the invention to provide a method and a system, based on closed chamber testing, wherein the above-mentioned weaknesses are at least essentially eliminated.

A more specific object of the invention is to provide a method and a system wherein the flow velocity of the formation fluid can be measured accurately by controlling the inflow and thereby the downhole pressure.

Further objects of the invention are to provide a system which facilitates testing and sampling without producing well fluids to the surface, and wherein the system is constructed such that a test can be stopped at any time and fluids reinjected into the reservoir.

For achieving the above-mentioned objects there is provided a method of the introductorily stated type which, according to the invention, is characterized in that, in a pipe section at the lower end of the test pipe, there is releasably retained a pig forming a barrier between formation fluid and a lightweight damping fluid filling the pipe above the pig, the pig being released at the start of the test and being moved in a controlled manner upwards in the pipe as a result of a positive pressure difference between the fluids below and above the pig.

Further, there is provided a system of the introductorily stated type which, according to the invention, is characterized in that it comprises a pig arranged to be retained releasably and in a sealing manner in a pipe section at the lower end of the test pipe, and a reservoir for a lightweight damping fluid arranged to be supplied to the test pipe via the flow head, in order to substantially fill the test pipe above the pig at the start of the test, so that the pig forms a barrier between fluid from the formation and the damping fluid above the pig.

The invention will be further described below in-connection with exemplary embodiments with reference to the drawings, wherein, FIG. 1 shows a schematic view of surface equipment necessary for carrying out a test according to the invention;

In the drawing figures corresponding parts and elements are designated by the same reference numerals.

Figure 1:
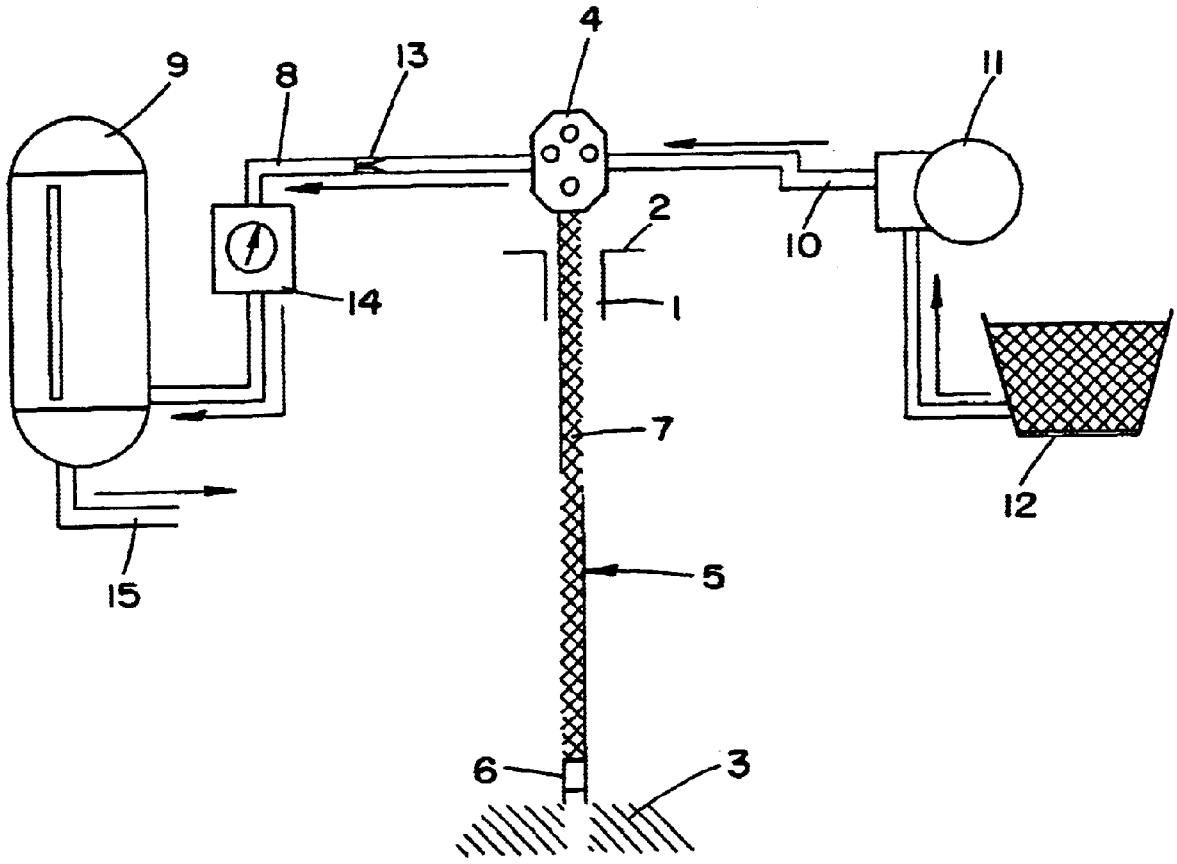

The schematic view in FIG. 1 shows circuit equipment which is necessary for effecting a closed chamber test according to the invention. In the figure there is suggested a borehole 1 extending from the surface 2 of the earth down to a hydrocarbon-carrying earth formation 3 which is to be tested. At the surface there is arranged a flow head 4 connected to the upper end of a test string or test pipe 5 extending through the borehole and its lower end being provided with a downhole assembly 6 comprising, inter alia, necessary equipment for testing and sampling of well fluids from the formation 3, as further described in connection with FIGS. 2 and 5. The shown cross-hatching symbolises that the test pipe 5 is filled with a lightweight cushion or damping fluid 7 which, during the execution of a test, is pressed upwards through the test pipe and supplied via the flow head 4 and a line 8 to a calibrated collecting tank. As a damping fluid there may suitably be used sea water, but the final choice of fluid will depend on the geological pressure gradient and the hydrocarbon-producing capacity of the formation.

The flow head 4 is also connected through a line 10 and a pump 11 to a tank 12 containing mud or damping fluid for supply to the test pipe by means of the pump 11. The flow head is provided with suitable valves (not shown) for opening and closing the connection between said lines and the test pipe as required.

On the line 8 there is also shown to be connected a flow control means in the form of a choke valve 13, and also a measuring unit 14 (optional) for measuring flow velocity. Further, the tank 9 has an outlet pipe 15 leading to a reinjection pump.

The equipment shown in FIG. 1 in practice, in connection with offshore oil drilling, may be arranged on a floating drilling rig, whereby the test pipe then will extend through the borehole up to a wellhead at the seabed, and further up through the body of water to the rig in question.

As stated above, a pig is arranged at the lower end of the test pipe, which pig is releasably retained in the downhole assembly 6 as further described below, and during a test forms a barrier between formation fluid flowing into the test pipe, and the damping fluid above the plug. At the start of a test sequence, the well is opened at the surface flow head 4 after that perforation has been carried out and the pig has been released, and the flow is directed towards the calibrated tank 9. The rate of flow is controlled by the choke 13, and flow velocity measurements are carried out by the measuring unit 14 and confirmed by physical measurements at the tank 9. In addition, measurement of pressure and temperature is carried out at the choke 13, and these parameters are also measured downhole and at the flow head 4.

After completion of the test the produced fluids are pumped back to the production interval in the formation 3 by use of the pump 11 and either mud or damping fluid from the mud tank system 12 on the relevant rig. Alternatively, the calibrated tank may be connected to the pump 11 and the produced damping fluid utilised once more as a displacement fluid.

The clean, incompressible and non-contaminating damping fluid which is placed above the pig, will function as a flow control as well as a volume control medium, as it is recovered in the calibrated tank 9.

Figure 2:
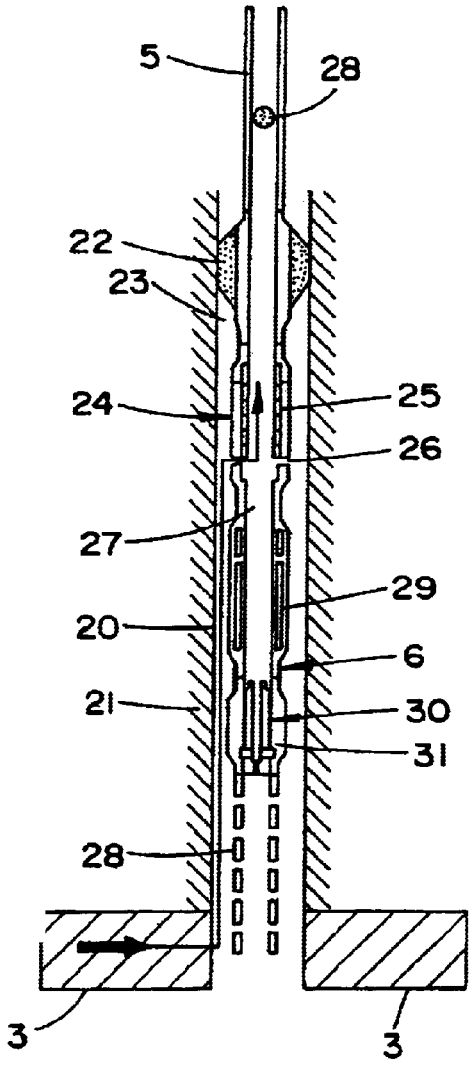
FIG. 2 shows a sectional view of the lower end portion of a borehole and the lower portion of a test pipe with an associated first embodiment of a downhole assembly in a system according to the invention.

An embodiment of a downhole or test assembly 6, which is arranged at the lower end of a production or test pipe 5, is shown in FIG. 2. As suggested in the figure, a casing 20 is placed in the borehole, which casing is cemented to the borehole wall with cement 21. At the upper end of the test assembly there is arranged a recoverable gasket 22 shutting off the annulus 23 between the casing 20 and the test pipe 5. Below the gasket 22 there is arranged a sliding sleeve or SS valve (SS=Sliding Sleeve) 24 having a sliding sleeve 25 which is shown in the open position, so that the sliding sleeve uncovers openings 26 between the annulus 23 and an axial passage 27 extending through the downhole assembly.

Above the gasket 22, the downhole assembly further comprises a downhole tester valve or DT valve (DT= Downhole Tester) 28, whereas a pipe member or fitting 29 is arranged below the sliding sleeve valve 24, which fitting contains pressure meters and samplers. The test assembly normally will also include other components which, however, are not further shown, since they will be well known to a person skilled in the art.

Figure 3:
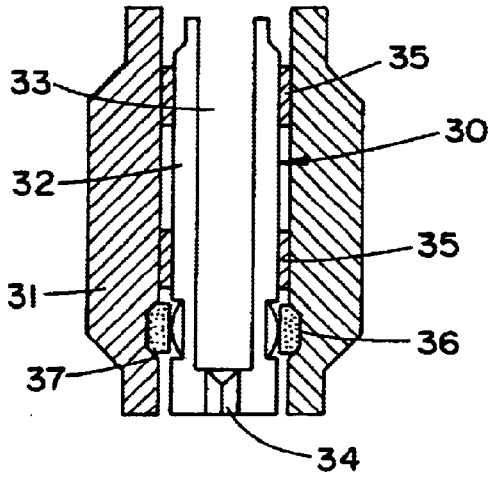
FIG. 3 shows a segment of the downhole assembly in FIG. 2, with a pig placed in the actual passage thereof.

The afore-mentioned pig is designated by the reference numeral 30 and in FIG. 2 is located in a pig launcher sub 31 arranged below the fitting 29. The pig or plug 30, which is shown on a larger scale in FIG. 3, comprises a sleeve-shaped body 32 having a through-going passage 33 which is blocked by a closing element 34, and an external resiliently expandable sealing means in the form of a pair of mutually spaced annular gaskets 35, e.g. of rubber, for sealing abutment against the inner wall of the passage 27 through the test assembly and against the inner wall of the test pipe 5. As appears, the pig 30 is provided with spring-loaded dogs 36 for resiliently releasable engagement in a ring groove 37 in the inner wall of the passage of the pig launcher sub 31. The spring force is adapted so that the pig is released from the ring groove at a predetermined pressure difference across the pig.

The closing element 34 of the pig is arranged to be removed from the passage 33 at a certain overpressure on the upper side of the element, so that the passage of the pig is opened for through-flow. Thus, the closing element provides a pump-out facility ensuring that fluids can circulate and the well be secured, also if the pig should get stuck in both directions. The closing element must secure pressure integrity from the lower side, so that it can only be pumped out at a predetermined pressure difference from the upper side.

As appears from FIG. 2, a perforated pipe length 38 is also arranged below the pig launcher sub 31, through which formation fluid can flow into the passage 27 of the downhole assembly when the borehole wall is perforated and the pig is released from the launcher sub and moved upwards in the test pipe 5.

As will be known to a person skilled in the art, the downhole assembly at its lower end will also include necessary equipment for perforating the casing 20 and the formation 3, more specifically a firing head and a perforating gun. Since the perforating process is of no consequence for the execution of the present test method, these elements are not further shown or described.

The execution of a test sequence in connection with the embodiment according to FIG. 2 will be further described below.

Before the commencement of a test, the test assembly 6 is run down the borehole, and the gasket 22 is placed at the necessary depth. Thereafter the hole is perforated as mentioned above. The initial conditions will be as follows:

- the volume below the gasket will be filled with drilling mud or salt water
- the annulus volume between the casing and the test pipe (production pipe), above the gasket, will be filled with drilling mud or salt water
- the test pipe above the DT valve will be filled with a light-weight damping fluid, e.g. water, to secure a positive difference between the hydrostatic pressures of the reservoir and the test pipe.

Figure 4:
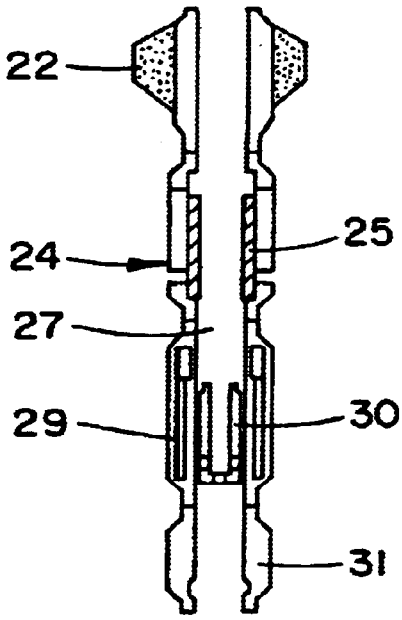
FIG. 4 shows a part of the downhole assembly in FIG. 2, with a sliding sleeve valve therein in closed position.

The test is initiated by opening the DT valve 28 by the supply of annulus pressure and by opening at the surface. Reservoir fluid then will flow from the reservoir and into the borehole and further into the test pipe via the open SS valve 24, as shown by arrows in FIG. 2. The quantity of displaced fluid may be monitored at the surface in that the fluid flows into the calibrated tank 9. When the estimated volume from the bottom of the test interval and up to the SS valve has been recovered, the DT valve 28 can be closed. Supply of an annulus pressure pulse will cause the SS valve to be closed as shown in FIG. 4, so that the reservoir is again isolated from the test string. The contaminated fluids now will be located above the pig 30, and pure reservoir fluids will be in the borehole. The test is restarted in that the DT valve is opened once again. A pressure difference will be produced across the pig, and at a predetermined value the vertical forces will be sufficient to overcome the pressure force keeping the pig in place in the launcher sub 31, and the pig will be free to move upwards in the passage 27 and further upwards in the test pipe 5. The velocity of the pig will be determined by the productivity of the test interval and by the velocity with which the fluid above the pig is allowed to flow into the tank 9. From this point of time the test may be interrupted at any stage, provided that one knows that the pig is situated above the DT valve, in order to produce pressure-build-ups, etc.

Figure 5:
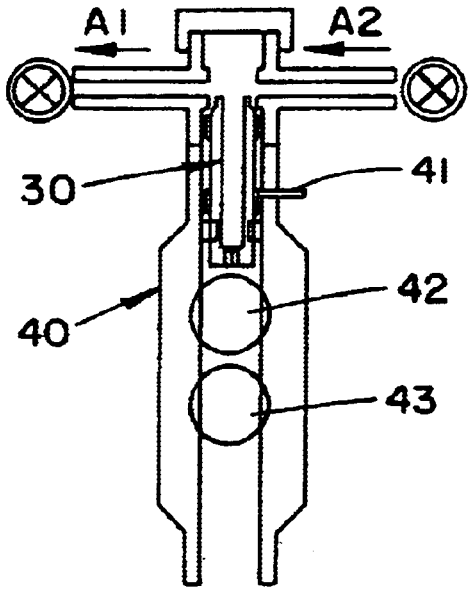
FIG. 5 shows the upper end of the test pipe with a surface type pig receiver and a pig which is introduced therein.
Figure 6:
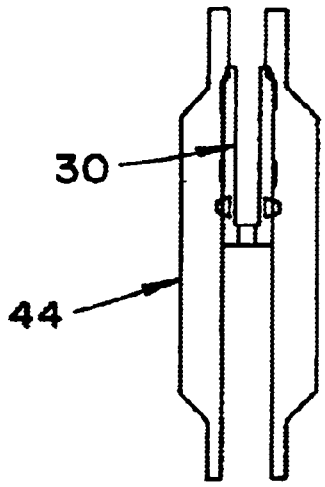
FIG. 6 shows a downhole type pig receiver in the test pipe.

The test will be terminated automatically when the pig arrives at and enters into a pig receiver arranged at a chosen place in the test pipe. Examples of such pig receivers are shown in FIGS. 5 and 6. Thus, FIG. 5 shows a dual valve pig receiver 40 of surface type, i.e. a receiver arranged at the surface, at the upper end of the test pipe 5. The receiver comprises a sensor 41 detecting and indicating when the pig 30 enters the receiver, and a pair of valves 42 and 43 which may then be closed below the pig, whereafter the pig can be taken up from the receiver before produced fluid is pumped back and down into the borehole. The arrows A1 og A2 shown in the figure illustrate flow to the collecting tank 9 and flow from a pump, respectively, e.g. the pump 11 in FIG. 1.

FIG. 6 shows a pig receiver 44 of downhole type, i.e. a receiver which is arranged at a chosen place along the length of the test pipe 5. In this case the arrival of the pig 30 is indicated in that the well flow stops and an increase of the downhole pressure takes place. It will here be necessary that a possibility is provided for taking the pig up from the pipe by means of a wire, in addition to the above-mentioned pump-out facility. An annulus pressure-operated circulation valve possibly may be arranged immediately below the receiver 44 to allow reinjection of fluids in case it should not be possible to pump through the pig.

Figure 7:
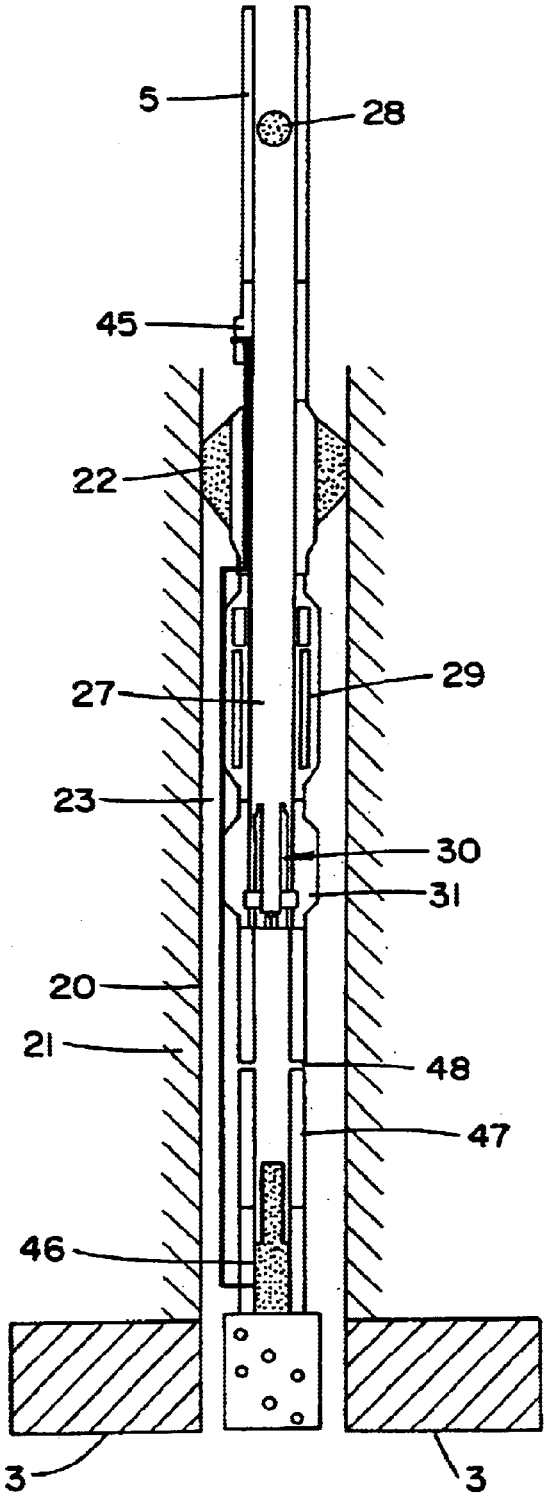
FIG. 7 shows a sectional view of the lower end portion of the borehole and the lower end portion of a test pipe with an alternative embodiment of the downhole assembly.

FIG. 7 shows an alternative embodiment of a downhole assembly for execution of the test method according to the invention. The components having corresponding counterparts in the embodiment in FIG. 2 are designated by the same reference numerals and do not need any repeated description. The construction and operation of this embodiment is not very different from the embodiment in FIG. 1, but the difference resides in that the sliding sleeve valve 24 in FIG. 2 is omitted and replaced by an annulus pressure cross-over sub 45 for transferring a pressure pulse to a perforating unit 46 comprising in a conventional manner a firing head and perforating guns. Further, there is arranged a gun release member 47 for automatic release of the unit 46 with the perforating guns at a point of release 48.

In this case the release mechanism for the pig 30 is the same as in the first example, but the initial fluid flow is not taken in above the pig. In order to avoid introducing large volumes of contaminated fluid in the system, the pig must be installed as close to the top of the test interval in the formation 3 as possible.

At the introduction of a test sequence in connection with the embodiment in FIG. 7, the detonating fuse of the perforating unit 46 is activated by means of an annulus pressure pulse. After a delay of 5–10 minutes the perforating guns detonate and perforate the casing and the adjacent parts of the formation, and the automatic gun release is activated so that the guns fall down into the bottom of the borehole. The bottom of the pig 30 now is uncovered for the well pressure, and at the predetermined pressure difference across the pig this is relieved and pressed upwards from the pig launcher sub.

The rest of the test will be carried out as described above, either the surface or the downhole pig receiver system being used for terminating the test.

When practising the method according to the invention it may be appropriate and desirable to use a test or production pipe having a larger inner diameter than the diameter of the passage through the downhole assembly, i.e. a pipe having a larger bore as a main part of the closed chamber. This allows flow of a larger volume and a reduction of the chamber length. This will entail that standard drill pipes may be used to transport the test assembly, something which results in a substantial saving with respect to time and money. For achieving an efficient seal in the production pipe having a larger diameter, there may then be used a dual pig or two-stage pig, as shown in FIG. 8.

Figure 8:
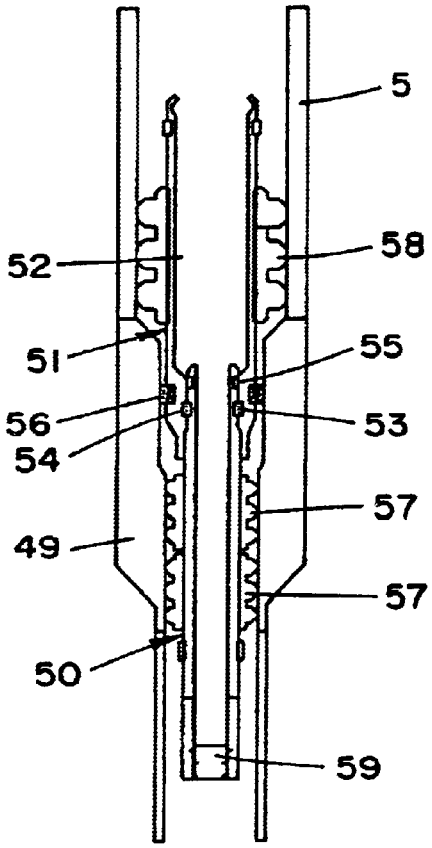
FIG. 8 shows a sectional view of an embodiment of a two-stage pig in a pig receiver.

In the embodiment in FIG. 8, the test or production pipe 5 at its lower end is shown to include a pig receiver 49 having a transition wherein the pipe passes into an upper part having a larger bore than the bore of the underlying part. The dual pig assembly comprises a lower pig 50 corresponding to the pig 30 described above, even if the detailed construction is shown to be somewhat different, and an upper pig 51. The pigs are arranged to co-operate with each other, the lower pig 50 being adapted to be introduced into and locked in a sealing manner at the lower end of a through passage 52 in the upper pig 51. For this purpose the pig 50 at its upper end is provided with outwards projecting dogs 53 for engagement in an annular locking groove 54 at the lower end of the passage 52 through the upper pig 51. Further, the lower pig at its upper end is provided with a sealing O ring 55. The upper pig 51 is provided with spring-loaded dogs 56 for releasable engagement in a suitable ring groove in the inner wall of the pig receiver 49, to keep the pig releasably in place thereby. The lower pig 50 is provided with a pair of resilient gasket elements 57 which are here shown to have outwardly projecting ribs for sealing engagement against the pipe wall. In a similar manner the upper pig 51 is provided with a resilient gasket element 58, e.g. a rubber seal, which also has outwards projecting ribs for sealing engagement against the inner wall of the pipe 5.

During the initial flow, i.e. while the lower pig or first stage pig 50 moves through the downhole assembly, the damping fluid may flow freely through the upper pig or second stage pig 51. When the lower pig 50 is introduced into the upper pig 51, the sealing ring 55 will seal the passage 52 through the pig. At the same time the locking dogs 53 will get into engagement and lock the two pigs to each other. The following increase of the differential pressure will overcome the spring force retaining the upper pig, and the assembly then will be free to move upwards. At the top of the production pipe 5 a pig receiver of a similar type as that described above, will retain the pig assembly, so that the closing element 59 at the lower end of the lower pig 50 may be driven out by means of pump pressure from above, or the pig assembly may be taken up from the pipe by means of a wire and a fishing tool.

FIGS. 9–12 show embodiments of lower and upper pig receivers which are modified to allow flow past the pig assembly without using the pump-out possibility, i.e. expulsion of the closing element 59 in FIG. 8 by means of pumping pressure from above. In these embodiments the pig receiver is equipped with by-pass or side channels and a pig-actuated spring means.

Figure 9:
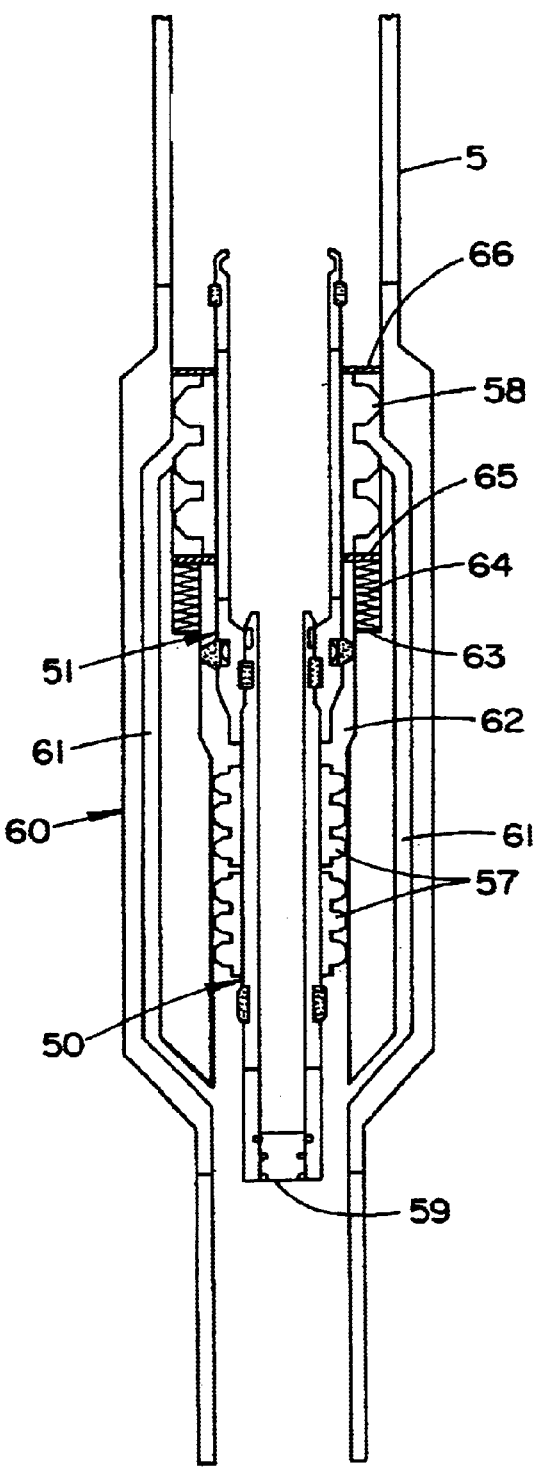
FIGS. 9 and 10 show sectional views of a modified lower pig receiver with a two-stage pig therein.
Figure 10:
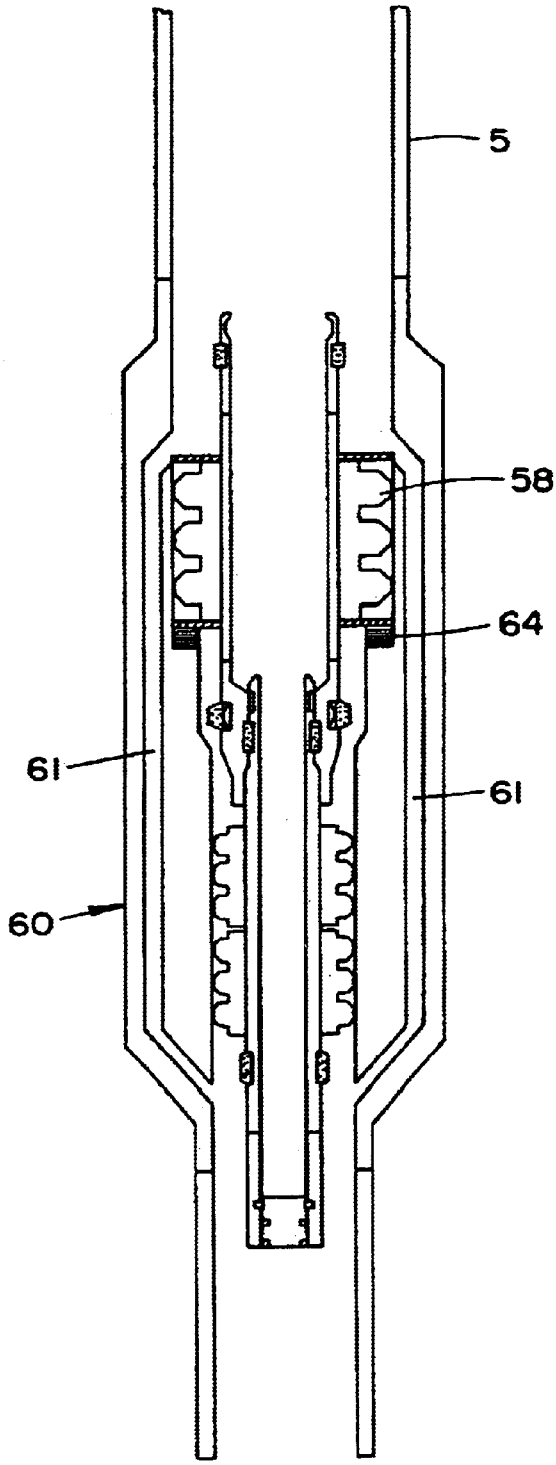

Thus, in the embodiment in FIGS. 9–10, a lower pig receiver 60 is provided with a number of side channels 61 arranged in the pig receiver wall outside of the pig receiving chamber 62. The inner chamber wall is stepped for the formation of an upwards directed, annular shoulder 63 for the support of a spring means 64 which may consists of a number of circumferentially distributed pressure springs. In the illustrated embodiment an encircling stop ring 65 resp. 66 is arranged at the upper and lower ends of the resilient gasket element 58 on the upper pig 51. The lower stop ring 65 serves as an abutment against the spring means 64, whereas the upper stop ring 66 serves as an abutment against a corresponding spring means arranged in an upper pig receiver, as described below.

Figure 11:
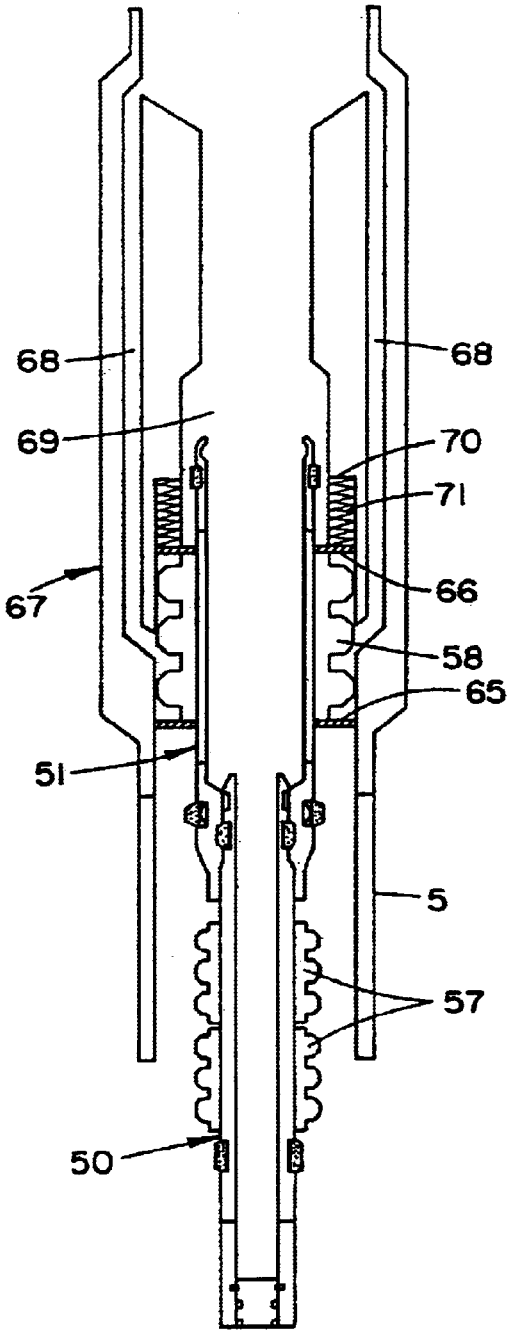
FIGS. 11 and 12 show sectional views of a modified upper pig receiver with a two-stage pig therein.
Figure 12:
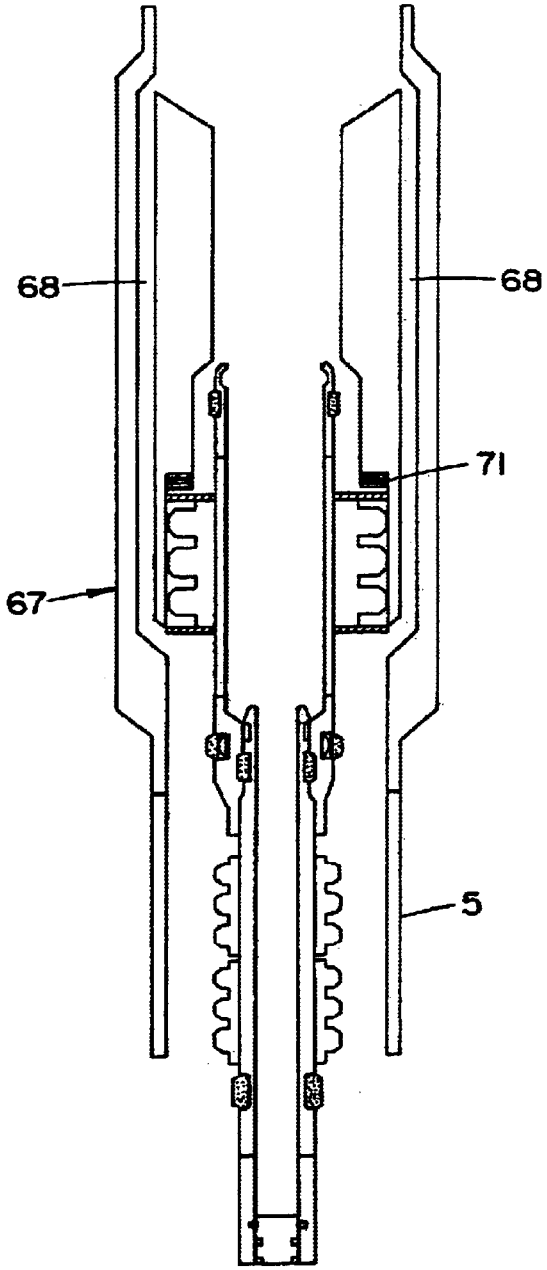

FIGS. 11 and 12 show an upper pig receiver 67 which is provided with a number of side channels 68 arranged in the pig receiver wall outside of the pig-receiving chamber 69, in a corresponding manner as in the embodiment in FIGS. 9–10. The inner chamber wall is stepped for the formation of a downwards directed, annular shoulder 70 against which there rests a spring means 71 which may consists of a number of circumferentially distributed pressure springs.

When the pig assembly 50, 51 has been installed in the lower receiver 61, and no force acts on the pig from above (or from below), the rubber seal 58 on the upper pig 51 will prevent communication across the pig via the by-pass channels 61, as shown in FIG. 9. When the fluid pressure (pump pressure) acts from above, the pig will compress the spring means 64, as shown in FIG. 10, and move downwards. Thereby, the by-pass channels 61 are opened for communication across the pig, and circulation is possible. When the pump pressure from the upper side is released, the spring means 64 will move the pig back to the normal position.

When the pig assembly 50, 51 is introduced into the upper pig receiver 67, no flow across the pig assembly will occur if the pressure from the underside is insufficient to compress the spring means 71. Flow in the side channels 68 is prevented by the rubber seal 58, as shown in FIG. 11. When pressure from the underside of the pig is sufficient to compress the spring means 71, the pig will move upwards, and communication across the pig is established, as shown in FIG. 12. When releasing the pressure from the underside, the spring means 71 will move the pig back to the normal position.

The afore-mentioned two-stage pigs possibly may be replaced by a single multi-function pig. The lower part of the two-stage pig then will be superfluous. Such an embodiment is shown in FIG. 13.

Figure 13:
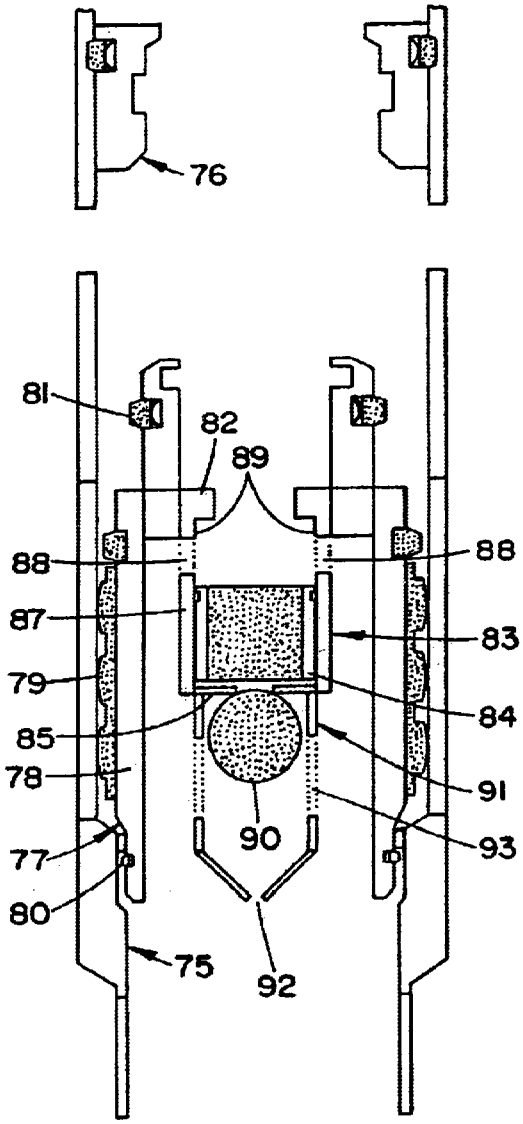
FIG. 13 shows a sectional view of an embodiment of a multi-function pig placed in a lower pig receiver or pig holder.

In FIG. 13 there is shown a lower pig receiver or pig holder 75 and an upper pig receiver or pig holder 76. The pig holders may be connected to each other via a test pipe or a production pipe (not shown). As shown, in the lower pig holder 75 there is placed a pig 77 having a pig body essentially corresponding to the pig body of the upper pig 51 in FIGS. 9–12, but wherein means are introduced into the interior of the pig to provide for opening or closing of the pig body with respect to fluid flow, in dependence of the relevant operational circumstances.

As appears from FIG. 13, the pig 77 comprises a sleeve-shaped pig body 78 surrounded by a gasket element 79 provided at its lower and upper ends with radially movable dogs 80 and 81, respectively, for releasable engagement in respective suitable locking grooves in the lower and upper pig holders 75 and 76. At its upper end the pig body has a centrally open transverse wall 82 from which there projects downwards a piston housing 83 receiving a vertically movable piston 84. The piston housing has a bottom wall 85 having a central inlet opening 86 (see FIG. 14), and a cylindrical wall member 87 having a number of upper flow ports 88 for allowing fluid flow through the pig body. The piston is dimensioned such that the flow ports 88 are open when the piston 84 is in a lower bottom position (shown in FIG. 13), whereas they are closed when the piston is in an upper top position (shown in FIGS. 16–19). The transverse wall 82 of the pig body 78 at the underside is formed with a recess for receiving the upper part of the piston 84, and a suitable locking means 89 is provided for releasable retention of the piston in the upper position thereof.

Further, there is provided a device for opening and closing of the inlet opening 86 of the piston housing in dependence of the density of the fluid surrounding the piston housing in a given operational situation. In the illustrated embodiment this device consists of a ball 90 which is movable towards and away from the opening 86 in a guide sleeve 91 projecting downwards from the piston housing 83 and terminating at the bottom in a funnel-shaped part having an outlet opening 92. The guide sleeve is provided with a number of side openings 93 for fluid flow. The ball 90 has a density which is lower than the density of water, but higher than the density of produced hydrocarbons, so that the position of the ball in the guide sleeve 91 will depend on the surrounding fluid. If this is water, the ball will be in an upper position in which the inlet opening 86 is closed. If the fluid is hydrocarbons, the ball will sink because of a lesser buoyancy, and will take a lower position in which the inlet opening 86 is open.

Additional equipment (for example a pressure meter, a fluid density measuring means and equipment for transmission of such information to the surface) possibly may be installed and suitably fastened in connection with the pig body. However, this is not shown or further described here.

Different operational sequences which will occur during operation when using a pig device according to FIG. 13, will be described below with reference to this figure and the FIGS. 14–20.

When the pig 77 has been installed in the lower pig holder 75, the well is filled with water, the piston 84 is in its lower position and the ball 90 in its upper position. The flow ports 88 through the pig are open and allow circulation (both ways) through the pig. This situation is shown in FIG. 13.

When there is produced from the well (the well is open), water and mud filtrates enter into the well and flow into the production pipe and through the pig. The ball 90 still is in its upper position according to FIG. 13.

Figure 14:
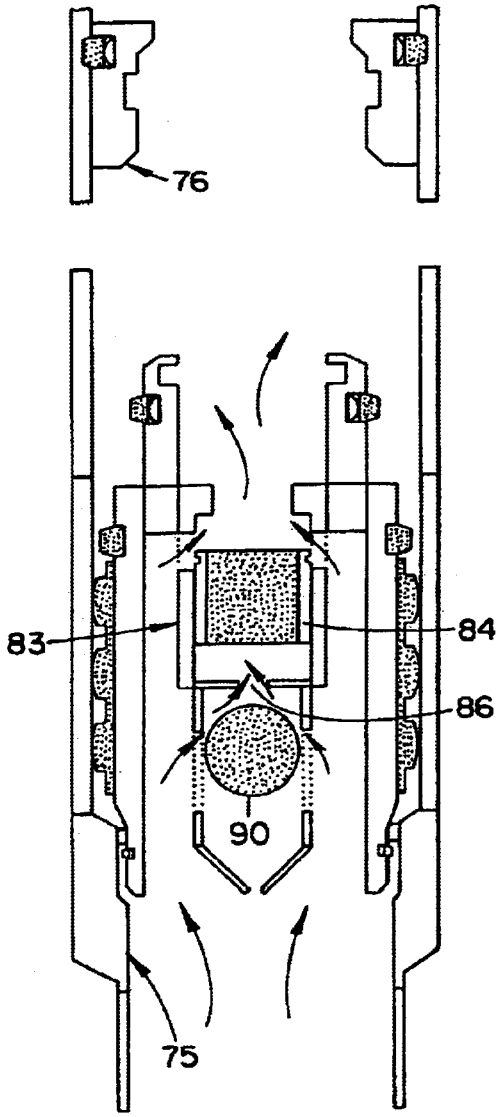
FIGS. 14–20 show corresponding sectional views as in FIG. 13 of the multi-function pig in different operational phases during transfer of the pig between the lower and an upper pig holder.
Figure 15:
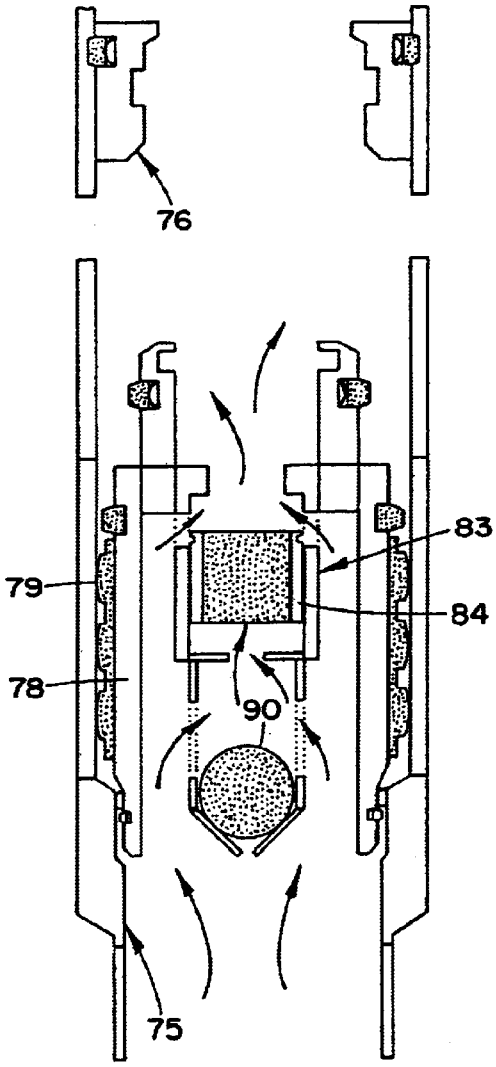

When hydrocarbons commence entering into the production pipe from the formation and flow through the pig, the ball 90 commences loosing buoyancy so that it sinks and makes it possible for the flow to go through the inlet opening 86 at the bottom of the piston housing 83, as shown in FIG. 14. The piston 84 thereby is influenced by forces from the underside, so that it begins moving upwards and begins closing the ports 88, as also shown in FIG. 14.

Figure 16:
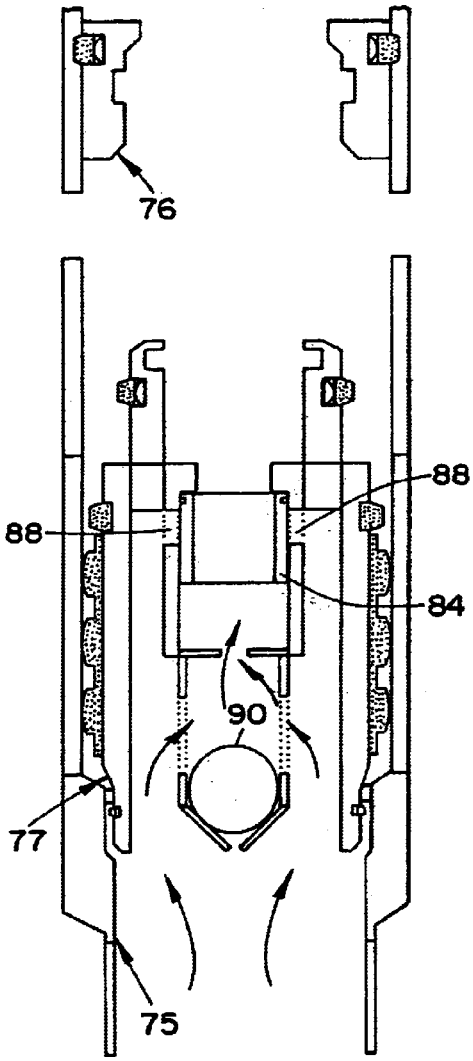

The ball 90 sinks to its lower position in the guide sleeve 91 (FIG. 15), and the piston 84 moves to its upper position and is locked in this position (FIG. 16). In this position the ports 88 are closed, and the fluid flow through the pig ceases. In this situation there will be water above the pig and hydrocarbons below the pig.

Figure 17:
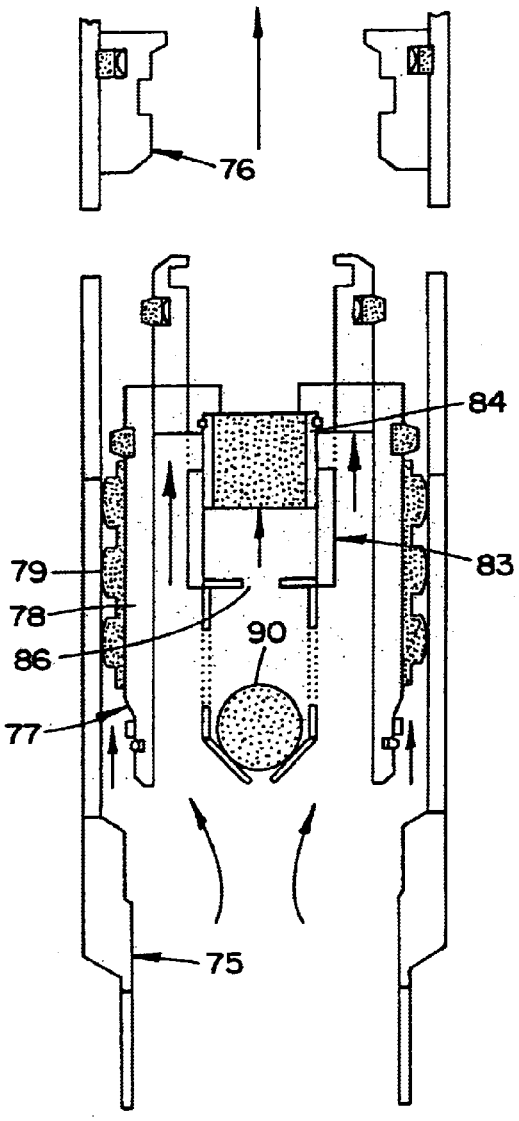

Forces will no act upon the pig itself, and will release the pig from the lower pig holder 75, as shown in FIG. 17. The pig moves within the production pipe while there is produced from the reservoir formation. There will still be hydrocarbons below the pig and water (and filtrates) above the pig.

Figure 18:
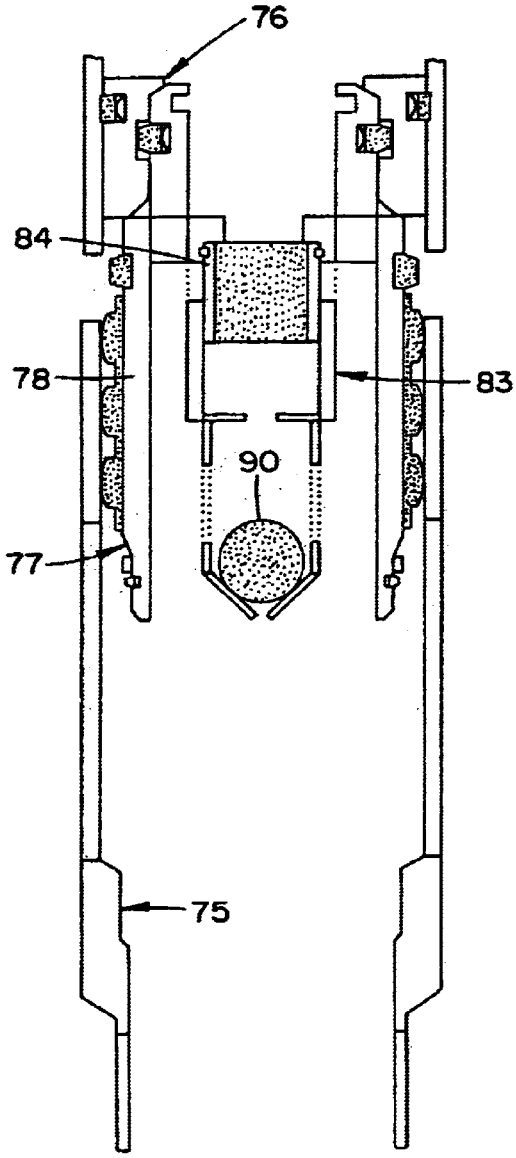

The pig 77 moves until the well is shut off at the surface (the pressure above the pig equalizes, or until the pig enters into and is locked in the upper pig receiver 76, as shown in FIG. 18.

The pig may be pumped back to the lower pig receiver 75 by pumping water (or mud) from the upper side. Sufficient pump pressure from the upper side is introduced to release the pig from the upper pig receiver 76. However, the piston 84 is not released at this stage, because of the fact that a much higher pump pressure (or pressure difference) is required in order to release the piston from the locking means 89.

When the pig is pumped down through the well pipe, the hydrocarbons below the pig will be pumped back and into the reservoir formation (where they came from).

Figure 19:
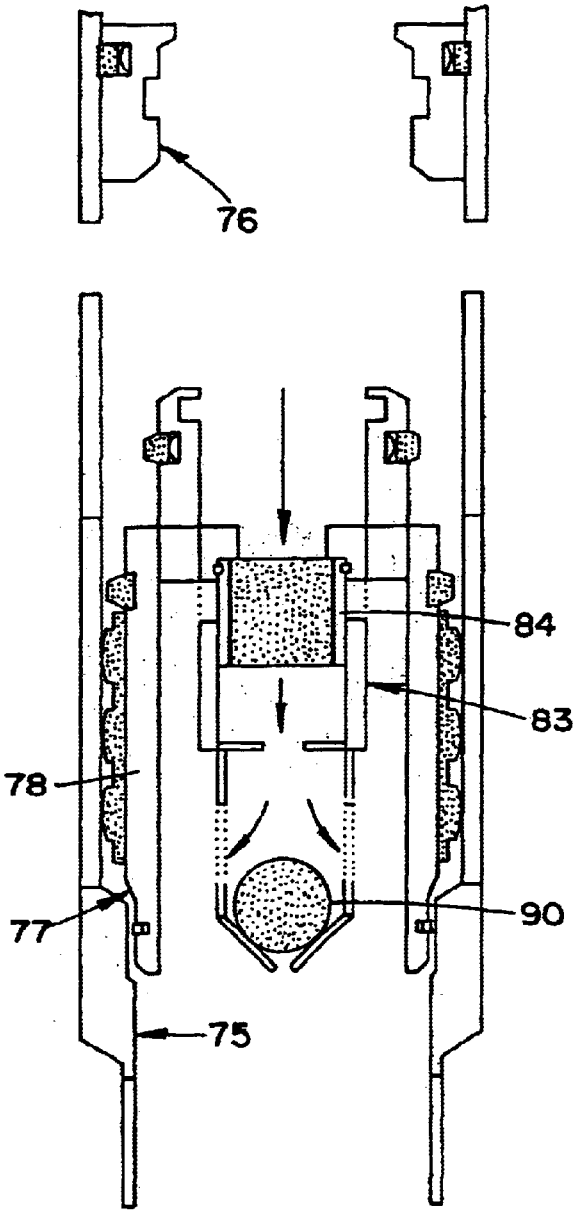

When the pig 77 is back in place in the lower pig receiver 75, the pig stops moving, and the pump pressure then acts on the piston 84 to release this from its locking position. This situation is shown in FIG. 19. When releasing the piston, this begins moving downwards and thereby frees the flow openings 88, so that fluid (water) above the pig is allowed to flow through the pig.

Figure 20:
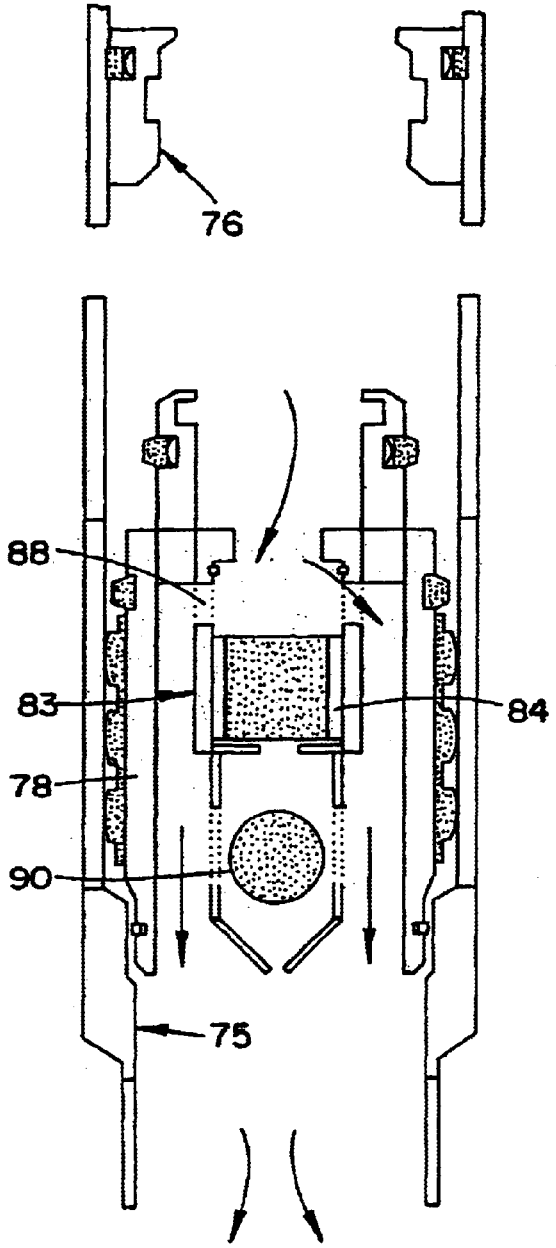

The piston 84 is gradually pumped back to the lower position in the piston housing 83, and water displaces hydrocarbons within and below the pig. The ball 90 begins moving back to the upper position because of the changes in fluid density and buoyancy. This situation is shown in FIG. 20. When the ball is back in its upper position, the inlet opening 88 at the bottom of the piston housing is closed, and full communication and circulation (both ways) through the pig is established.

Another possible embodiment with respect to introduction of equipment within the pig, is a downhole valve that can be operated (opened and closed) from the surface (for example on a rig) by means of telemetric signals. The valve will be opened when flowing water through the pig, and closed when hydrocarbons are identified as flowing through the pig. A density identifier may be connected to the downhole valve, and may transmit flow information (density of produced fluid) to the surface, thus indicating when the valve should be opened or closed.

What is claimed is:

1. A method of testing a borehole in an underground formation by the use of so-called closed chamber testing, wherein a test pipe (5) is lowered into the borehole (1), which pipe is closable at its upper end and at its lower end is provided with a downhole assembly (6) comprising equipment for testing of fluid flow from the formation (3), the annulus (23) between the test pipe and a casing (20) in the borehole being shut off during the test by a gasket (22) at a desired depth, and fluid from the formation being allowed to flow through the test pipe (5) to a collecting tank (9) coupled to the test pipe at the upper end thereof, characterized in that, in a pipe section at the lower end of the test pipe (5), there is releasably retained a pig (30) forming a barrier between formation fluid and a lightweight damping fluid (7) filling the test pipe above the pig, the pig (30) being released at the start of the test and being moved in a controlled manner upwards in the pipe (5) as a result of a positive pressure difference between the fluid below and above the pig.

2. A method according to claim 1, characterized in that the pig (30) is released as a result of the positive pressure difference between the fluids below and above the pig.

3. A method according to claim 1 or 2, characterized in that formation fluid at the start of the test is allowed to be conducted past the pig (30) and into the test pipe (5) via a valve means (24) at a place above the pig, and that the valve means is closed after that formation fluid has displaced an estimated volume of damping fluid upwards in the test pipe (5), so that the flow path past the pig (30) is shut off and the underside of the pig is subjected to well pressure, whereafter the pig is released when the differential pressure across the pig has obtained a predetermined value.

4. A method according to claim 1 or 2, characterized in that the test is terminated automatically as a result of the fact that the pig (30) enters into a pig receiver (40;44) at a chosen place in the upper part of the test pipe (5).

5. A system for testing a borehole in an underground formation by the use of so-called closed chamber testing, comprising a test pipe (5) which is adapted to be lowered into the borehole (1) and at its lower end is provided with a downhole assembly (6) comprising equipment for testing of fluid flow from the formation (3), a gasket (22) for shutting off the annulus (23) between the test pipe (5) and a casing (20) in the borehole, and a collecting tank (9) coupled to the test pipe via a flow head (4) at the upper end of the test pipe, characterized in that it comprises a pig (30) arranged to be retained releasably and in a sealing manner in a pipe section at the lower end of the test pipe (5), and a reservoir (12) for a lightweight damping fluid (7) arranged to be supplied to the test pipe (5) via the flow head (4), in order to substantially fill the test pipe above the pig (30) at the state of the test, so that the pig forms a barrier between fluid from the formation and the damping fluid above the pig.

6. A system according to claim 5, characterized in that the pig (30) comprises a sleeve-shaped body (32) having a through-going passage (33) which is blocked by a closing element (34), and an external, resiliently expandable sealing means (35) for sealing abutment against the inner wall of the test pipe (5).

7. A system according to claim 5, characterized in that the pig (30) is provided with spring-loaded dogs (36) for releasable engagement in a ring groove (37) in an inner wall of a launcher sub (31) for the pig, the spring force being adapted in such a manner that the pig (30) is released from the ring groove at a predetermined pressure difference across the pig.

8. A system according to claim 6, characterized in that the closing element (34) of the pig is arranged to be removed from the pass ate (33) at a certain overpressure on the upper side of the element, so that the passage of the pig (30) is opened for thorough-flow.

9. A system according to any one of claims 5–8, characterized in that the test pipe (5) comprises an upper part having a larger internal diameter than the lower part of the pipe, and that the pig (50) is arranged to co-operate with an additional pig member (31) for slidable sealing engagement against the inner wall of the upper part of the test pipe (5), the pig (50) being arranged to be introduced into and locked in a sealing manner at the lower end of a through going passage (52) in the additional pig member (51).

10. A system according to claim 9, characterized in that the pig (50) at its upper end is provided with outwards projecting dogs (53) for engagement in an annular locking groove (54) at the lower end of the passage (52) through the additional pig member (51).

11. A system according to claim 6, characterized in that the test pipe (5) comprises a pig receiver (60; 67) which is provided with at least one side channel (61; 68) for fluid flow, and with a spring means (64; 71) arranged to be influenced by a pig (50; 51) situated in the pig receiver (60, 67), the sealing means (58) of the pig being arranged to shut off the side channel (61; 68) when the pig is not pressure influenced, and to open the side channel by compressing the spring means (64; 71) by an external pressure influence on the pig in the compression direction of the spring.

12. A system according to claim 5, characterized in that the pig (77) comprises a pig body (78) forming a piston housing (83) for receiving a piston (84), and having a bottom wall (85) with an inlet opening (86) and a wall member (87) with upper ports (88) allowing flow of fluid through the pig when the piston (84) is in a lower position in the piston housing, the piston in an upper position causing closing of the ports (88), and that a device (90, 91) is provided causing opening or closing of the inlet opening (86) of the piston housing (83) in dependence of the surrounding fluid.

13. A system according to claim 12, characterized in that the device for opening/closing consists of a ball body (90) which is movable in a guide sleeve (91) towards and away from the inlet opening (86), the ball body (90) having a density which is smaller than the density of water, but larger than the density of presumably produced hydrocarbons.

* * * * *